US010495332B2

(12) United States Patent
Wang et al.

(10) Patent No.: US 10,495,332 B2
(45) Date of Patent: Dec. 3, 2019

(54) HUMIDIFYING DEVICE AND AIR TREATMENT SYSTEM

(71) Applicant: QINGDAO HAIER AIR CONDITIONER GENERAL CORP., LTD., Shandong (CN)

(72) Inventors: Youning Wang, Shandong (CN); Zhenxue Zhu, Shandong (CN); Jianguo Wang, Shandong (CN); Mingjing Fan, Shandong (CN); Jialan Zhuang, Shandong (CN); Aibing Liu, Shandong (CN); Yuanwei Dong, Shandong (CN); Wenming Yan, Shandong (CN); Liqin Wu, Shandong (CN)

(73) Assignee: QINGDAO HAIER AIR CONDITIONER GENERAL CORP., LTD., Shandong (CN)

( * ) Notice: Subject to any disclaimer, the term of this patent is extended or adjusted under 35 U.S.C. 154(b) by 259 days.

(21) Appl. No.: 15/323,014

(22) PCT Filed: Dec. 8, 2014

(86) PCT No.: PCT/CN2014/093269
§ 371 (c)(1),
(2) Date: Dec. 29, 2016

(87) PCT Pub. No.: WO2016/041262
PCT Pub. Date: Mar. 24, 2016

(65) Prior Publication Data

US 2017/0138621 A1 May 18, 2017

(30) Foreign Application Priority Data

Sep. 18, 2014 (CN) ..... 2014 1 0478524

(51) Int. Cl.
*B01D 53/02* (2006.01)
*F24F 6/04* (2006.01)
(Continued)

(52) U.S. Cl.
CPC ..... *F24F 6/04* (2013.01); *F24F 1/02* (2013.01); *F24F 13/20* (2013.01); *F24F 13/28* (2013.01)

(58) Field of Classification Search
CPC .... F24F 13/20; F24F 13/28; F24F 1/02; F24F 3/14; F24F 6/04; F24F 6/043
See application file for complete search history.

(56) References Cited

U.S. PATENT DOCUMENTS 3,823,926 A 7/1974 Bracich
4,026,971 A 5/1977 Glasoe
(Continued)

FOREIGN PATENT DOCUMENTS

CN 2462287 Y 11/2001
CN 101493253 A 7/2009
(Continued)

OTHER PUBLICATIONS

International Search Report and Written Opinion for Application No. PCT/CN2014/093269 dated Jun. 9, 2015.

*Primary Examiner* — Christopher P Jones
(74) *Attorney, Agent, or Firm* — Alston & Bird LLP

(57) ABSTRACT

A humidifying device, comprising an air duct (1) penetrating through the interior of the humidifying device, and a water absorption filter element (3) which is fitted over the top of an outer wall surrounding the air duct (1). According to the humidifying device, water is conveyed into the air duct (1) through the water absorption filter element (3) by means of
(Continued)

the structural arrangement of a water channel (2) and the water absorption filter element (3), and humidifying operation is therefore carried out.

12 Claims, 3 Drawing Sheets

(51) Int. Cl.

| | |
|---|---|
| ***F24F 1/02*** | (2019.01) |
| ***F24F 13/20*** | (2006.01) |
| ***F24F 13/28*** | (2006.01) |

(56) References Cited

U.S. PATENT DOCUMENTS

| | | | | |
|---|---|---|---|---|
| 4,706,552 | A | 11/1987 | Maguire | |
| 5,765,544 | A | 6/1998 | Vigansky, Jr. | |
| 5,851,444 | A * | 12/1998 | Hansell, Jr. | F24F 6/043 261/106 |
| 2007/0075446 | A1* | 4/2007 | Bushee | F24F 6/00 261/30 |
| 2007/0217771 | A1* | 9/2007 | Granger | A01M 1/2033 392/386 |
| 2009/0184174 | A1* | 7/2009 | Johnson | B05B 17/085 239/12 |
| 2012/0071078 | A1* | 3/2012 | Yang | F24F 6/04 454/237 |
| 2014/0084495 | A1* | 3/2014 | McDonnell | F24F 6/14 261/78.2 |
| 2014/0232022 | A1* | 8/2014 | Chung | B05B 15/065 261/78.1 |
| 2016/0153672 | A1* | 6/2016 | McDonnell | F24F 6/14 261/5 |

FOREIGN PATENT DOCUMENTS

| | | | |
|---|---|---|---|
| CN | 101846372 | A | 9/2010 |
| CN | 202928004 | U | 5/2013 |
| CN | 204301243 | U | 4/2015 |
| GB | 2070966 | A | 9/1981 |
| GB | 2177933 | A | 2/1987 |
| JP | 2000074429 | A | 3/2000 |
| KR | 20090127576 | A | 12/2009 |
| KR | 20120082827 | A | 7/2012 |
| KR | 20130107535 | A | 10/2013 |

* cited by examiner

HUMIDIFYING DEVICE AND AIR TREATMENT SYSTEM

CROSS-REFERENCE TO RELATED APPLICATIONS

This application is a national phase entry filed under 35 U.S.C. § 371 of International Application No. PCT/CN2014/093269 filed Dec. 8, 2014, which application claims the benefit of priority of Chinese Patent Application No. 201410478524.1 filed on Sep. 18, 2014, the content of which is incorporated herein by reference in its entirety.

TECHNICAL FIELD

The present invention belongs to the field of air handling equipment and, in particular, to a humidifying device and an air handling system.

BACKGROUND OF THE INVENTION

Air humidity, as a parameter for describing the physical state of the air, is closely related to the health of the human body. In general, when the relative humidity of the air is between 40%-70%, the human intuitive feel is relatively comfortable. During the winter heating period and the spring sandstorm period in China's northern area, the relative humidity of the indoor air is very low, the human body feels uncomfortable, and therefore the indoor humidification is very necessary. Currently on the market, mainstream humidification technology can be divided into three categories: electric heating technology, ultrasonic technology and wet film type humidification technology. However, for the electric heating technology, the power consumption is high and the security is poor; the ultrasonic technology is not good for the health of the human body; and for the wet film humidifying technology, the wet film is easy to breed bacteria and molds; therefore, these three humidification technology is not the best humidification means, and it is of great value and significance to find a humidifying device which is ideal for health.

SUMMARY OF THE INVENTION

In view of this, an object of the present invention is to propose a humidifying device, comprising an air duct penetrating through the interior of the humidifying device, and a water absorption filter element, which is snap-fitted with the top of an outer wall surrounding the air duct, wherein the water absorption filter element covers the top of the air duct as an air outlet.

Preferably, the humidifying device further comprises a water channel formed by the outer wall surrounding the air duct, the water absorption filter element extending downward into the water channel.

Preferably, the humidifying device further comprises an inner annular snap-fitting support body, which is snap-fitted to the top of the outer wall of the air duct, and which comprises a hollow side wall, one end of which is connected to an outer wall of the water channel and the other end is a water absorption filter element bearing part which shields the air duct and supports the water absorption filter element.

Preferably, the height of the outer wall of the air duct is equal to the height of the inner annular snap-fitting support body.

Preferably, the humidifying device comprises an outer annular snap-fitting support body for fixing the water absorption filter element and a retaining ring for retaining the water absorption filter element, wherein the water absorption filter element is provided in the outer annular snap-fitting support body and is jointly snap-fitted to the inner annular snap-fitting support body, the retaining ring is arranged in the outer annular snap-fitting support body in a freely detachable manner, and the water absorption filter element is interposed between the outer annular snap-fitting support body and the retaining ring.

Preferably, the water absorption filter element bearing part is of a grid-like structure or a net-like structure.

Preferably, the water absorption filter element is higher than an inner wall of the water channel.

Preferably, the water absorption filter element is of a multilayer net-like structure.

Preferably, the humidifying device further comprises a humidifying housing which surrounds half of the air duct and mates closely with the water channel, wherein the water channel surrounds the barrel-like outer wall of the air duct and forms an inner humidifying housing with the humidifying housing; and the water channel is integrated with the inner humidifying housing and surrounds the outer wall of the air duct.

Preferably, a slide rail is provided at the bottom of the inner humidifying housing, and a slideway is provided at the bottom of the water channel matching closely with the humidifying housing, which slideway matches with and is slidably connected to the slide rail.

Preferably, the humidifying device further comprises a humidifying top cover provided on the top surface of the humidifying device, and a humidifying chassis provided on the bottom surface of the humidifying device, and the air duct penetrates through the humidifying top cover and the chassis.

Preferably, the humidifying chassis is provided with a lower power source interface and a lower communication interface at the bottom thereof, and the humidifying top cover is provided with an upper power source interface and an upper communication interface. Another object of the present invention is to provide an air handling system, comprising a base and one or more air handling devices disposed on the base, the one or more air handling devices comprising at least one of a humidifying device, a dehumidifying device and a purifying device, wherein the humidifying device is the dehumidifying device as described above.

According to the humidifying device provided in the present invention, the structure having a water channel and a water absorption filter element is arranged such that the water is conveyed into the air duct through the water absorption filter element so as to carry out the humidifying operation, the structure is simple, the safety performance is good, there is no "white-powder" pollution, and it is easy to clean the device; and the principle of natural evaporation is adopted, so that the present invention is more green and healthy.

BRIEF DESCRIPTION OF THE DRAWINGS

The accompany drawings constituting part of the present invention are used to provide a further understanding of the present invention; and exemplary embodiments and illustrations thereof of the present invention are used to explain the present invention, and do not unduly limit the present invention. In the drawings.

DETAILED DESCRIPTION OF THE INVENTION

Figure 1:
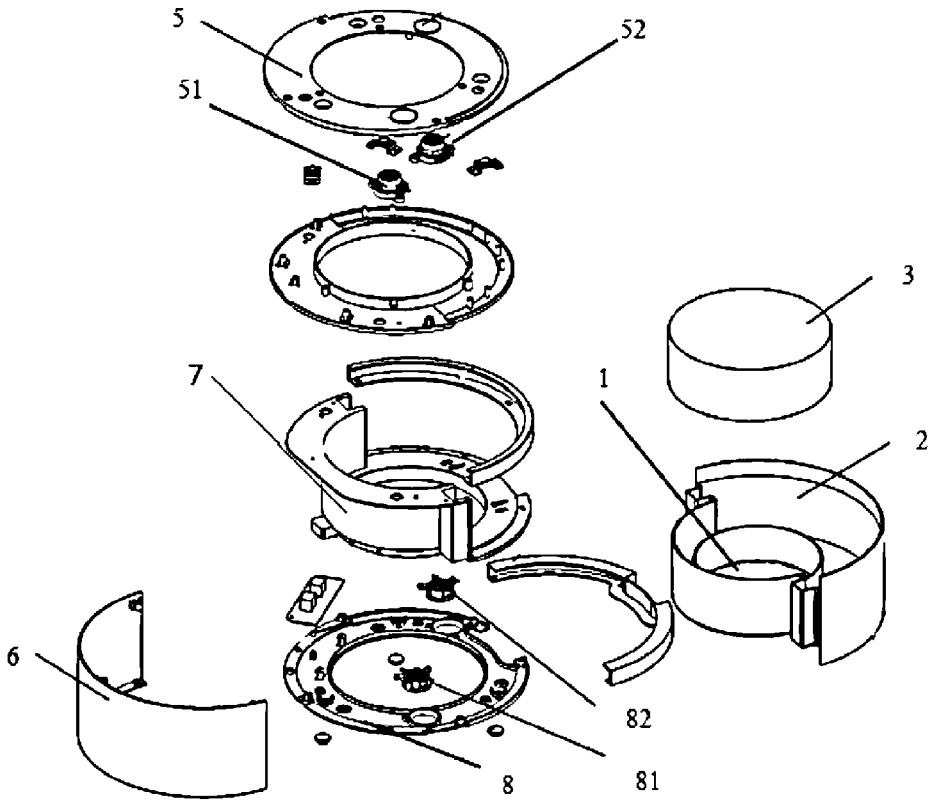
FIG. 1 is an exploded view of a humidifying device provided in the present invention.
Figure 2:
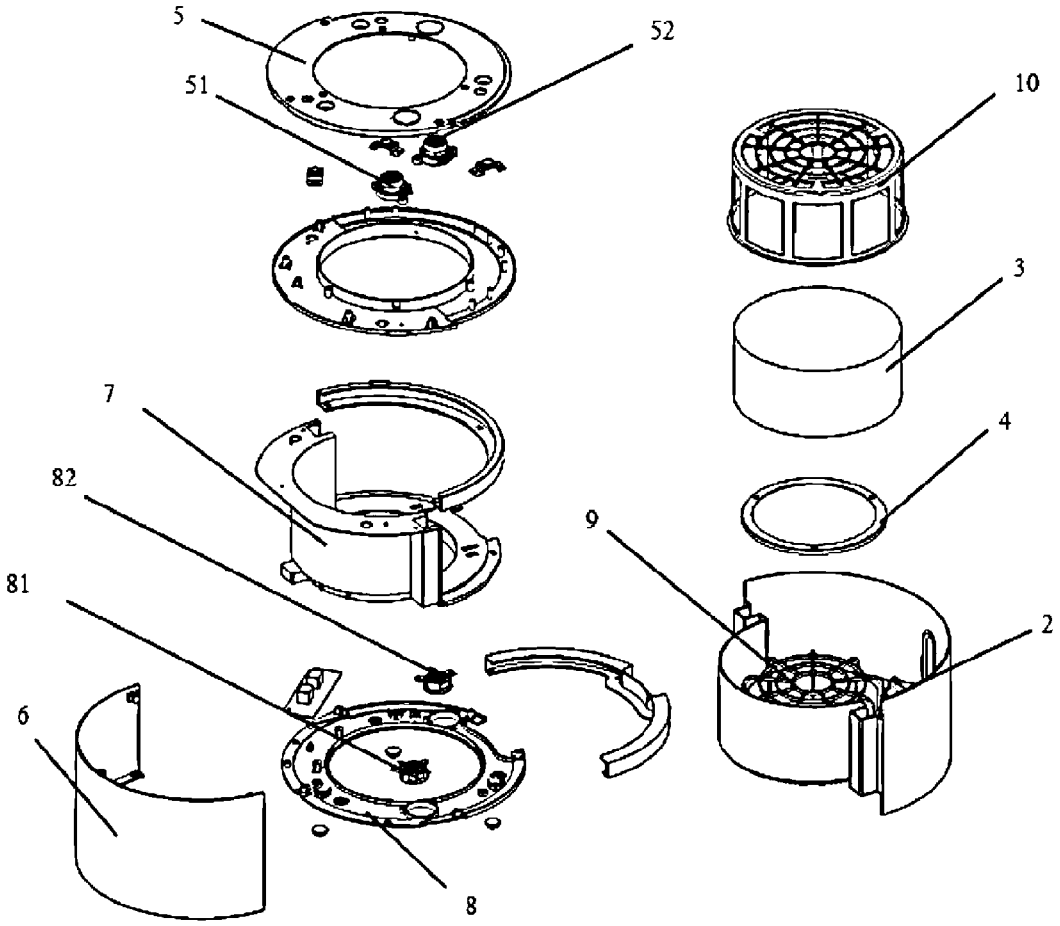
FIG. 2 is an exploded view of additional inner and outer annular snap-fitting support bodies of the humidifying device provided in the present invention.

The following description and the accompany drawings fully illustrate specific embodiments of the present invention so as to enable those skilled in the art to practice the same. Other embodiments may include structural, logical, electrical, procedural, and other changes. The embodiments represent only possible variations. Individual components and functions are optional, and the order of operations may vary, unless explicitly required. Portions and features of some embodiments may be included in or replace portions and features of other embodiments. The scope of the embodiments of the present invention encompasses the full scope of the claims, and all available equivalents of the claims. In this context, these embodiments of the present invention may be individually or collectively referred to by the term "invention" for convenience only, and if in fact more than one invention is disclosed, it is not intended to automatically limit that the application is within the scope of any single inventive or inventive concept.

The humidifying device as shown in FIGS. 1-5 comprises an air duct 1 penetrating through the interior of the humidifying device, and a water absorption filter element 3, which is snap-fitted with the top of an outer wall surrounding the air duct 1, wherein the water absorption filter element 3 covers the top of the air duct as an air outlet. In this way, the air passing through the air duct can be remove the water or vapour from the water absorption filter element 3 for humidification.

The humidifying device further comprises a water channel 2 formed by the outer wall surrounding the air duct 1, and the water absorption filter element 3 extends downward into the water channel 2.

The humidifying device further comprises an inner annular snap-fitting support body 9 snap-fitted to the top of the outer wall of the air duct 1, and the inner annular snap-fitting support body 9 comprises a hollow side wall, one end of which is connected to an outer wall of the water channel 2 and the other end is a water absorption filter element bearing part which shields the air duct 1 and supports the water absorption filter element 3.

The height of the outer wall of the air duct is equal to the height of the inner annular snap-fitting support body.

The humidifying device comprises an outer annular snap-fitting support body 10 for fixing the water absorption filter element 3 and a retaining ring 4 for retaining the water absorption filter element, wherein the water absorption filter element 3 is provided in the outer annular snap-fitting support body 10 and is jointly snap-fitted to the inner annular snap-fitting support body 9, the retaining ring 4 is arranged in the outer annular snap-fitting support body 10 in a freely detachable manner, and the water absorption filter element 3 is interposed between the outer annular snap-fitting support body 10 and the retaining ring The water absorption filter element 3 is fixed by arranging the inner and outer annular snap-fitting support bodies 9 and 10, which does not block the air passing through the air duct.

The water absorption filter element bearing part is of a grid-like structure or a net-like structure.

The water absorption filter element 3 is higher than an inner wall of the water channel.

The water absorption filter element 3 is of a multilayer net-like structure.

The humidifying device further comprises a humidifying housing 6 which surrounds half of the air duct 1 and mates closely with the water channel 2, wherein the water channel 2 surrounds the barrel-like outer wall of the air duct 1 and forms an inner humidifying housing 7 with the humidifying housing 6; and the water channel 2 is integrated with the inner humidifying housing 7 and surrounds the outer wall of the air duct 1.

A slide rail is provided at the bottom of the inner humidifying housing 7, and a slideway is provided at the bottom of the water channel 2 matching closely with the humidifying housing 6, which slideway matches with and is slidably connected to the slide rail.

The humidifying device further comprises a humidifying top cover 5 provided on the top surface of the humidifying device, and a humidifying chassis 8 provided on the bottom surface of the humidifying device, and the air duct 1 penetrates through the humidifying top cover 5 and the chassis 8.

The humidifying chassis 8 is provided with a lower power source interface 81 and a lower communication interface 82 at the bottom thereof, and the humidifying top cover 5 is provided with an upper power source interface 51 and an upper communication interface 52.

In some optional embodiments, the inner wall of the water channel 2 surrounds the air duct 1, and the water absorption filter element 3 is nested outside the inner wall of the water channel 2 by means of a groove. The water absorption filter element 3 functions to improve the evaporation efficiency and purify the water in the water channel 2; therefore, the water absorption filter element 3 is also designed to annularly extend along the air duct 1 to match with the annular structure in the water channel 2 so as to allow the air to pass through the water channel 2 and also to pass through the water absorption filter element 3, thereby increasing the humidifying rate.

Further, in order to increase the area of the water absorption filter element 3 in contact with the wind, the water absorption filter element 3 is higher than the inner wall of the water channel 2 in designing the structure of the water absorption filter element 3. The inner wall of the water channel 2 is lower than the outer wall, and the height of the water absorption filter element 3 is the same as the height of the outer wall; therefore, the area of the water absorption filter element 3 in contact with the wind throughout the humidification process comprises, in addition to the area of the upper surface, the area of a side wall of the water absorption filter element 3 that is higher than the inner wall.

Optionally, the water absorption filter element 3 may be designed to be tapered, and the structure of the inner wall of the corresponding water channel 2 may be configured accordingly.

In some illustrative embodiments, the water channel 2 is separate from the housing of the humidifying device, and the humidifying housing 6 is provided with a groove for having the water channel 2 placed therein.

The housing of the humidifying device comprises a humidifying top cover 5, a humidifying housing 6, an inner humidifying housing 7 and a humidifying chassis 8. The inner humidifying housing 7 is fixedly connected to the humidifying housing 6 in such a manner as to be screw-connected, adhesive bonded or snap-fitted etc., the inner humidifying housing 7 is provided with a groove the structure of which matches with the water channel 2, so that the water channel 2 can be freely detached from the housing of the humidifying device for the convenience of the user. The upper portion of the water channel 2 is then connected to the inner humidifying housing 7 via an upper connecting bar, and the lower portions of the inner humidifying housing 7 and the humidifying housing 6 are fixedly connected to the humidifying chassis 8 in such a manner as to be screw-connected, adhesive bonded or snap-fitted etc.

Furthermore, the bottom of the inner humidifying housing 7 is spaced from the humidifying chassis 8 by a certain distance, and a humidifying computer board (i.e. a humidifying PC) for controlling the humidifying device is provided in the gap between the humidifying casing 6 and the inner humidifying housing 7; the side of the inner humidifying housing 7 that is surrounded by the humidifying housing 6 may be fixed to the humidifying chassis 8 via a bolt and the bottom edge of the other side of the inner humidifying housing 7 may be connected to the humidification chassis 8 via the lower connecting bar.

Optionally, a slide rail may be provided on the groove of the inner humidifying housing 7 and a slideway may be provided in the corresponding position on the bottom of the water channel 2 to facilitate the removal of the water channel 2 more quickly and effortlessly.

Optionally, the humidifying top cover 5 is provided with an air outlet, the upper surface of the water absorption filter element 3 in the water channel 2 can be observed from the air outlet, that is, it is understood that the upper surface of the water absorption filter element 3 is exposed to the air, so that the diameter of the air outlet is prevented from being designed too small, hindering the evaporation and escaping rates of the water vapour.

Optionally, the humidifying top cover 5 is not disposed directly on the upper surface which is formed by the inner humidifying housing 7 and the upper connecting bar, and the humidifying top cover 5 is spaced from the upper surface at a distance in which a series of assemblies are provided, such as a power source interface and a communication interface. A lower power source interface and a lower communication interface are provided on the humidifying top cover 5; and similarly, a corresponding upper power source interface and upper communication interface are also provided on the humidifying chassis 8. Therefore, it is necessary to provide an insulating cover for insulating the water vapour between the humidifying top cover 5 and the upper surface which is formed by the inner humidifying housing 7 and the upper connecting bar, and the humidifying top cover 5 is fixedly connected to the insulating cover. The lower power source interface, the lower communication interface, the upper power source interface and the upper communication interface may employ the structure of the first terminal block or the second terminal block of the connector as described above.

In some optional embodiments, the air duct 1 runs through the centre of the humidifying device and is also located in the centre of the water absorption filter element 3.

Figure 3:
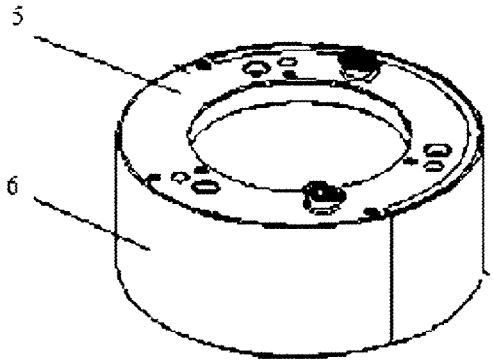
FIG. 3 is a perspective view of the humidifying device provided in the present invention.
Figure 4:
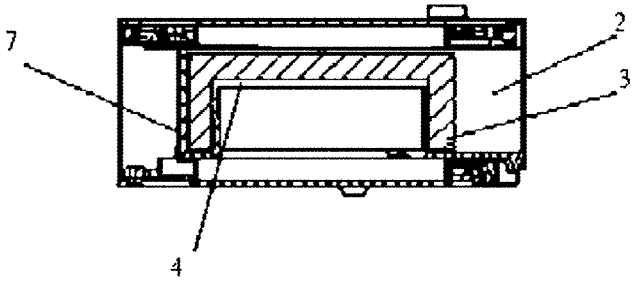
FIG. 4 is a sectional view of the humidifying device provided in the present invention.
Figure 5:
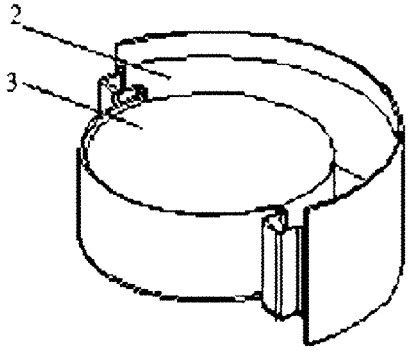
FIG. 5 is a partial schematic view of a water absorption filter element and a water channel of the humidifying device provided in the present invention.

Since the air duct 1 needs to pass through the whole humidifying device, the whole humidifying device can be regarded as a ring-like structure (in cross section), the shapes of the inner and outer rings may be the same or different, and the inner or outer ring may be of a round, square or triangular structure; and the humidifying device is preferably concentrically ring-shaped, i.e. the structure as shown in FIG. 3, and this design is more conducive to ventilation and evaporation of the water vapour.

Optionally, the shape of the inner ring defines the structure of the air duct 1, and the longitudinal section of the air duct 1 may be rectangular or be of other structures such as a trapezoid; for a better understanding, if the longitudinal section of the air duct 1 is rectangular, it is approximately understood that the air duct 1 is of a cylinder or cubic structure, and if the longitudinal section is a trapezoidal, the air duct 1 may be of a nearly circular cone structure.

Optionally, the humidifying device is provided with a connecting structure which is connected to the other devices as described above; the connecting structure may be a guiding structure, such as a guide groove and a guide post, the guide post and the corresponding guide groove of the respective devices being arranged to mate with each other, for example, a guide groove is provided on the humidifying top cover 5, and a guide post is provided on the humidifying chassis 8. In addition, a lower magnet and an upper magnet may be also respectively provided on the humidifying top cover 5 and the humidifying chassis 8, so that the humidifying device is connected to other devices by means of attraction.

With the above embodiment, the following effects can be achieved: a simple structure, a good safety performance, no "white-powder" pollution, and easy to clean the device; and the principle of natural evaporation is adopted, such that the present invention is more green and healthy.

The description and the accompany drawings fully illustrate specific embodiments of the present invention so as to enable those skilled in the art to practice the same. Other embodiments may include structural, logical, electrical, procedural, and other changes. The embodiments represent only possible variations. Individual components and functions are optional, and the order of operations may vary, unless explicitly required. Portions and features of some embodiments may be included in or replace portions and features of other embodiments. The scope of the embodiments of the present invention encompasses the full scope of the claims, and all available equivalents of the claims. In this context, these embodiments of the present invention may be individually or collectively referred to by the term "invention" for convenience only, and if in fact more than one invention is disclosed, it is not intended to automatically limit that the application is within the scope of any single inventive or inventive concept.

What is claimed is:

1. A humidifying device, characterized by comprising an air duct penetrating through the interior of the humidifying device;

a water absorption filter element, which is snap-fitted with the top of an outer wall surrounding the air duct, wherein the water absorption filter element covers the top of the air duct as an air outlet; and an inner annular snap-fitting support body, which is snap-fitted to the top of the outer wall of the air duct, and which comprises a hollow side wall, one end of which is connected to an outer wall of the water channel and the other end is a water absorption filter element bearing part which shields the air duct and supports the water absorption filter element.

2. The humidifying device according to claim 1, characterized by further comprising a water channel formed by the outer wall surrounding the air duct, the water absorption filter element extending downward into the water channel.

3. The humidifying device according to claim 1, characterized in that the height of the water channel is not less than the length of the side wall of the inner annular snap-fitting support body.

4. The humidifying device according to claim 3, characterized by further comprising an outer annular snap-fitting support body for fixing the water absorption filter element and a retaining ring for retaining the water absorption filter element, wherein the water absorption filter element is provided in the outer annular snap-fitting support body and is jointly snap-fitted to the inner annular snap-fitting support body, the retaining ring is arranged in the outer annular snap-fitting support body in a freely detachable manner, and the water absorption filter element is interposed between the outer annular snap-fitting support body and the retaining ring.

5. The humidifying device according to claim 1, characterized in that the water absorption filter element bearing part is of a grid-like structure or a net-like structure.

6. The humidifying device according to claim 1, characterized in that the water absorption filter element is higher than an inner wall of the water channel.

7. The humidifying device according to claim 6, characterized in that the water absorption filter element is of a multilayer net-like structure.

8. The humidifying device according to claim 1, characterized by further comprising a humidifying housing which surrounds half of the air duct and mates closely with the water channel, wherein the water channel surrounds a barrel-like outer wall of the air duct and forms an inner humidifying housing with the humidifying housing; and the water channel is integrated with the inner humidifying housing and surrounds the outer wall of the air duct.

9. The humidifying device according to claim 8, characterized in that a slide rail is provided at the bottom of the inner humidifying housing, and a slideway is provided at the bottom of the water channel matching closely with the humidifying housing, which slideway matches with and is slidably connected to the slide rail.

10. The humidifying device according to claim 1, characterized by further comprising a humidifying top cover provided on the top surface of the humidifying device, and a humidifying chassis provided on the bottom surface of the humidifying device, wherein the humidifying housing, the inner humidifying housing and the water channel are interposed between the humidifying top cover and the humidifying chassis, and the air duct penetrates through the humidifying top cover and the chassis.

11. The humidifying device according to claim 10, characterized in that the humidifying chassis is provided with a lower power source interface and a lower communication interface at the bottom thereof, and the humidifying top cover is provided with an upper power source interface and an upper communication interface.

12. An air handling system, characterized by comprising a base and one or more air handling devices disposed on the base, the air handling devices comprising at least one humidifying device, wherein the humidifying device is the humidifying device as claimed in claim 1.

* * * * *